United States Patent [19]

Collins, Jr.

[11] Patent Number: 4,718,676

[45] Date of Patent: Jan. 12, 1988

[54] BALL CATCHING CUP WITH LEG ATTACHMENT

[76] Inventor: Felton F. Collins, Jr., 1138 E. 73rd St., Los Angeles, Calif. 90001

[21] Appl. No.: 890,384

[22] Filed: Jul. 28, 1986

[51] Int. Cl.[4] ..... A63B 67/00

[52] U.S. Cl. ..... 273/324; 273/323; 273/412; 273/DIG. 18; 273/DIG. 30

[58] Field of Search ..... 273/318, 323, 324, 346, 273/412, 414, 415, DIG. 18, DIG. 30, DIG. 17, DIG. 19, 320, 359, 398, 399, 400, 405, 407, 1.5 R, 1.5 A, 179 A

[56] References Cited

U.S. PATENT DOCUMENTS

| | | | |
|---|---|---|---|
| 2,097,106 | 10/1937 | Stewart | 273/324 |
| 2,617,651 | 11/1952 | Gerhold | 273/324 |
| 2,930,618 | 3/1960 | Glintz | 273/323 |
| 3,471,150 | 10/1969 | Kaerwer | 273/179 A X |
| 3,610,622 | 10/1971 | Haroski | 273/412 |
| 4,042,241 | 8/1977 | Collins | 273/DIG. 17 X |

FOREIGN PATENT DOCUMENTS

| | | | |
|---|---|---|---|
| 909812 | 9/1972 | Canada | 273/DIG. 17 |

*Primary Examiner*—William H. Grieb

*Attorney, Agent, or Firm*—Julius Rubinstein

[57] ABSTRACT

A ball catching net is provided with clamping means for attachment to the legs of persons with impaired arm and hand functions. The net has a base portion and automatic ball ejecting means are attached to it. An electric power source is connected to the automatic ball ejecting means. Trigger means are mounted in the net and are connected to the ball ejecting means in such a way that the trigger means are actuated to forcibly eject a ball from the net only when a ball is caught in the net. In this way a game of catch can be played by persons with impaired arm and hand functions.

4 Claims, 6 Drawing Figures

FIG. 1.
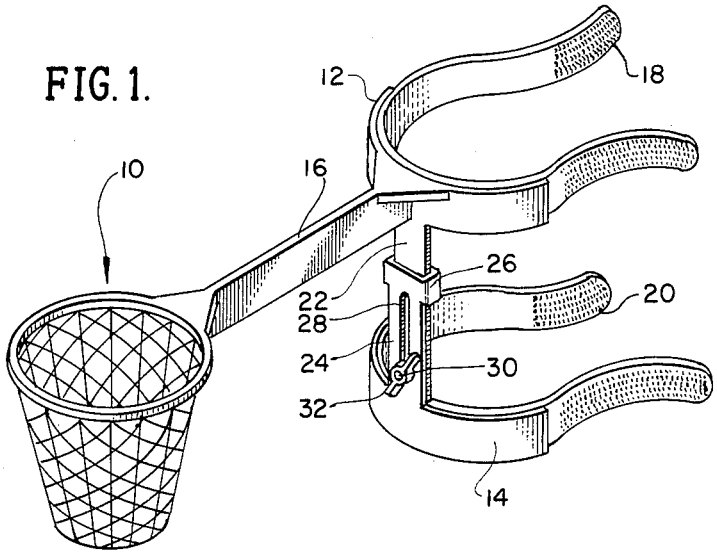
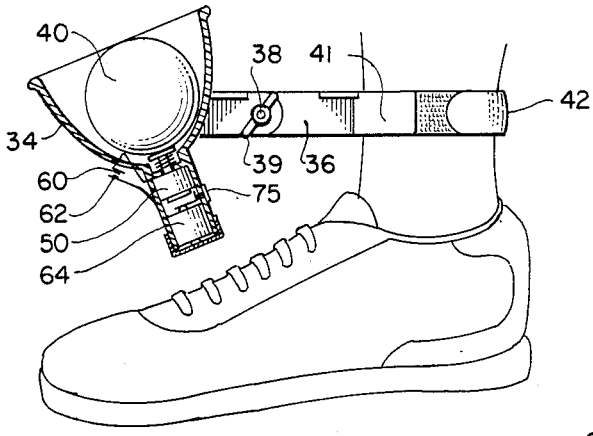
FIG. 2.
FIG. 6.
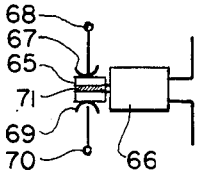
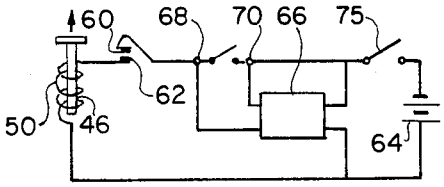
FIG. 5.
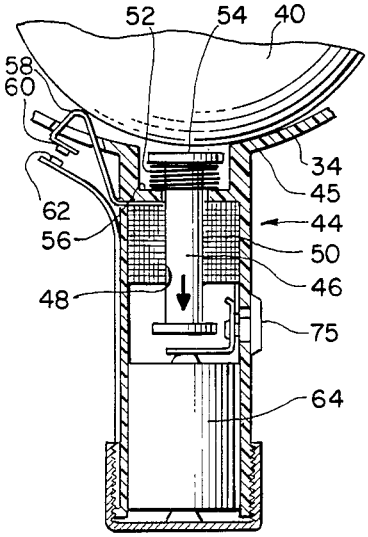
FIG. 3.
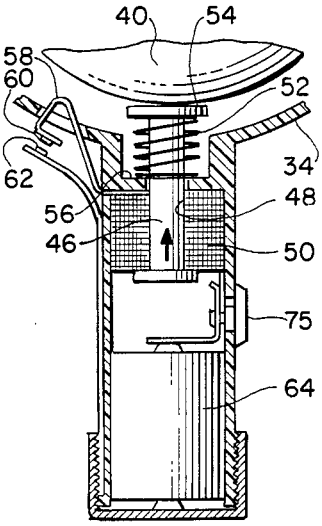
FIG. 4.

BALL CATCHING CUP WITH LEG ATTACHMENT

This invention relates to a game and more particularly to a ball and catch game which can be played both by handicapped and normal persons.

BACKGROUND AND BRIEF SUMMARY

Ball and catch games have always commanded the interest of people, but handicapped persons with impaired arm functions have been unable to particpate.

Heretofore, ball and catch games, as exemplified by the patent to Haroski U.S. Pat. No. 3,610,622, which do not require the use of the arms, have been devised which utilize a basket attached to the body of a person and a tethered ball attached to the basket. The object of the game being for the player to move his body in such a way as to cause the tethered ball to fly up and land in the basket. This kind of game has, however, inherent limitations in that it does not require interaction between other persons. Consequently, after a while the game becomes boring.

A ball and catch game which could be played by persons having normal as well as impaired arm functions would be useful because handicapped persons with impaired arm functions could play with each other as well as with normal persons. This athletic interaction would be exciting and physically beneficial to the players.

In its simplest form a basket is attached to the leg of a player. As the player kicks his leg, a ball in the basket flies out to be caught in a basket attached to the leg of another player.

In another form, a ball ejecting mechanism can be attached to the basket of a player, which when actuated, ejects the ball from the basket so it can travel a distance far enough to be caught in a basket attached to the leg of another player.

What is needed therefore and comprises an important object of this invention is to provide equipment which permits handicapped persons to play ball and catch games with each other and with persons with normally functioning limbs.

This and other objects of this invention will become more apparent when better understood in the light of the accompanying specification and drawings wherein:

FIG. 1 is a perspective view of one embodiment of the invention disclosing a ball catching basket with leg clamps for attachment to the leg of a player.

FIG. 2 is an elevational view of a modification of the invention showing a ball catching cup attached to the leg of a player with a ball ejecting mechanism attached to the ball catching cup.

FIG. 3 is a sectional elevational view of the ball ejecting mechanism in a retracted position.

FIG. 4 is a sectional elevational view of the ball ejecting mechanism shown in FIG. 3 in a ball ejecting position.

FIG. 5 is a circuit diagram disclosing the operation of the ball ejecting mechanism.

FIG. 6 discloses the circuit interrupting device shown in the circuit diagram in FIG. 5.

Referring now to FIG. 1 of the drawing, a ball catching net or basket 10 is attached to spaced parallel "C" clamps 12 and 14 by means of a support bar 16. Each C clamp comprises the usual arm portions and a connecting bow portion. At least a part of each "C" clamp is formed from Velcro fastner straps 18 and 20 so that the clamps can be securely strapped to the legs of the player.

Adjustment bars 22 and 24 are attached to the "C" clamps 12 and 14 for varying the spacing between them. Adjustment bar 24 has a generally channel shaped guide 26 for receiving the bar 22 and holding it aligned with bar 24. In addition, adjustment bar 24 is slotted at 28 so the bolt 30 attached to the bar 22 can project through the slot 28. By tightening the wing nut 32, the vertical spacing between the "C" clamps, 12 and 14 can be varied to accomodate differently shaped legs.

With this net arrangement, as stated above, when a ball is thrown or bounced the player runs and attempts to catch the ball in basket or net 10.

At least the base portion of the modified net or cup 34 shown in FIG. 2 is formed from a hard plastic. This base portion has an armature receiving opening through which the armature 46 extends. The cup or net 34 is pivotally attached to support bar 36 by pivot bolt 38. The support bar in turn is attached to a clamp 41 which embraces the ankle of a player by means of the velcro fastener strap 42. In FIG. 2 the basket is angled at 65° to the surface of the ground. However, the angle of the cup can be changed in accordance with the preference of the player by adjusting wing nut 39 threaded on pivot bolt 38.

In one embodiment (not shown), the cup 34 is simply attached to the ankle of the player and the player kicks his leg in such a way as to cause the ball to fly out of the cup so it can be caught and returned by another player.

In the embodiment shown in FIG. 2 a ball ejecting mechanism is provided.

In this embodiment, an electromagnet 44 is mounted in the base 45 of the cup 34. An armature 46 is slidably mounted inside the core 48 of the coil 50 of the electromagnet. When the electromagnet is energized the armature is drawn into the core 48 of the coil, see FIG. 3. When this happens the armature compresses spring 52 which is mounted between the ball hitting flange or the cap 54 at the top of the armature and the surface 56 at the base of the cup 34. When the electromagnet is deenergized, see FIG. 4, the compressed spring 52 ejects the armature out of the core 48 of the coil 50 so the ball hitting flange 54 strikes the ball 40 in the cup, driving the ball out of the cup.

The coil is energized when a ball falls into the cup 34. To do this, a spring member 58 is mounted in the base of the cup. This spring member is deflected downward when a ball falls into the cup. When this happens it causes electrical contacts 60 and 62 to close. This, as will be explained below, energizes the coil 50, because the circuit from the battery 64 is completed, see FIG. 5. As stated above, when the coil is energized, the spring 52 is compressed.

Referring to FIGS. 5 and 6, a circuit interrputing device comprising an electric motor 66 drives an electrically conductive shaft 65. Shaft 65 has a nonconductive strip 71 on its surface. Electric brushes 67 and 69 connected to terminals 68 and 70, see FIG. 5, brush against the motor shaft 65. The motor is connected across the power source 64. The motor operates when the main control switch 75 is closed causing the shaft 65 to rotate.

As long as the brushes do not rub against the nonconductive strip 71, the terminals 68 and 70 shown in FIG. 5 are electrically connected together. When one of the brushes rubs against the nonconductive strip 71, the connection between terminals 68 and 70 is interrupted.

The period of time the connection between the terminals 68 and 70 is interrupted, can be controlled by varying the speed of the motor or the width of the nonconductive strip 71.

When the contacts 68 and 70 are closed and contacts 60 and 62 are closed due to a ball falling into the cup, the coil 50 is energized causing the armature to be drawn into the coil 44 and causing the spring 52 to be compressed. If the ball should fall into the cup during the brief interval when the contacts 68 and 70 are open, contacts 60 and 62 will still close, but an instant later when contacts 68 and 70 are closed by the rotation of the shaft 65, the coil becomes energized and the armature is drawn into the coil causing the spring 52 to be compressed. But when the contacts 68 and 70 open again, because of the continued rotation of shaft 65, the coil 50 is de-energized. This causes the spring 32 to forcibly eject the armature from the core of the electromagnet. This in turn causes the armature flange 54 to strike the ball in the cup, driving it from the cup, explained above.

In summary to this point, when a ball falls into the cup, it causes the coil 50 to become energized drawing the armature into the core of the coil. When the rotating shaft 65 causes contacts 68 and 70 to open, the spring 52 ejects the ball 40 from the cup. The time periods when the contacts 68 and 70 must be opened and closed can be controlled by adjusting the speed of the motor or varying the width of the non-conductive strip 71. This in turn depends on the time required for the armature to be drawn into the core of the coil and the time required for the armature driven by the compressed coil spring 52 to eject the ball from the cup 34, It is apparent, that with the device described above, modified ball games such as Ping Pong, could even be played by persons confined to a wheel chair. For those less seriously inpaired, a soccer-like form of ball game might be possible.

Having described the invention what I claim as new is:

1. A ball and catch game comprising a ball receiving net, said net having a base portion, one end of a rigid support bar secured to the rim of the net, a first leg embracing C clamp comprising arm portions and a connected bow portion, the opposite end of said support bar connected to said bow portion of said first C clamp, an adjusting bar rigidly connected to the bow of said C clamp and extending in a downward direction transverse to the plane defined by the arms and bow of the first C clamp, a second ankle embracing C clamp comprising arm portions and a connected bow portion, said second C clamp disposed in a plane which is in spaced parallel relationship to said first C clamp, said second C clamp having an adjusting bar receiving channel extending in an upward direction transverse to the plane defined by the arms and bow of said second C clamp, said adjusting bar receiving channel receiving the adjusting bar depending from the first C clamp, and locking means connected between the adjusting bar and the adjusting bar receiving channel to vary and lock the separation between the first and second C clamps so that the spaced first and second C clamps can be clamped to legs having different lengths.

2. The ball and catch game described in claim 1 wherein said net has automatic ball ejecting means attached thereto, an electric power source connected to said automatic ball ejecting means, trigger means mounted in said net and connected to said ball ejecting mean, said trigger means actuated to eject a ball from the net only when a ball is caught in said net whereby the ball and catch game can be played by persons having impaired arm and hand functions.

3. A ball and catch game for persons with impaired arm or hand functions comprising a ball receiving net, said net having a base portion, one end of a rigid support bar secured to the rim of the net, a first leg embracing C clamp comprising arm portions and a connected bow portion, the opposite end of said support bar connected to the said bow portion of said first C clamp, an adjusting bar rigidly connected to the bow of said C clamp and extending in a downward direction transverse to the plane defined by the arms and bow of the first C clamp, a second ankle embracing C clamp having arm portions and a connected bow portion and positioned in a plane in spaced parallel relationship below the first C clamp, said second C clamp having an ajusting bar receiving channel connected to the bow portion of said second clamp and extending in an upward direction transverse to the plane defined by the arms and bow of said second C clamp, said adjusting bar receiving channel sized to receive the adjusting bar depending from the first C clamp, and locking means connected between the adjusting bar and the adjusting bar receiving channel to vary and lock the seperation between the first and second C clamps so the spaced first and second C clamps can be clamped to legs having different lengths, automatic ball ejecting means attached to said net, said automatic ball ejecting means including an electromagnet, an armature slidably mounted in the core of the electromagnet and extending through said base portion of the net, an enlarged ball hitting flange mounted on the end of said armature, a coil spring mounted on said armature, said coils spring sized so it abuts the said ball hitting flange and the base portion of said net, so that when the electro magnet is energized, the armature is drawn into the core of the electromagnet compressing said coil spring between said flange and said base portion of the net, and a trigger switch mounted in the net in such a way that said trigger switch closes when a ball falls into said net, an electric circuit connected to said trigger switch so that when a ball falls into said net and closes said trigger switch the electromagnet is energized drawing the said armature into the core of said electromagnet and compressing said spring between said ball hitting flange and the base portion of said net, said circuit including circuit interrupting means connected to said trigger switch in such a way that after said electromagnet is energized drawing said armature into its core and compressing said spring, the circuit is interrupted causing the magnetic force exerted by the electromagnetic to disappear so that the coil spring suddenly expands ejecting the retracted armature from the core of the electromagnet until the ball hitting flange strikes the ball in the net driving it out of the net.

4. A ball and catch game for persons with impaired arm or hand functions comprising a ball receiving net, said net having a base portion, automatic ball ejecting means attached to said net, said automatic ball ejecting means including an electromagnet, an armature slidably mounted in the core of the electromagnet and extending through said base portion of the net, an enlarged ball hitting flange mounted on the end of said armature, a coil spring mounted on said armature, said coils spring sized so it abuts the said ball hitting flange and the base portion of said net, so that when the electro magnet is energized, the armature is drawn into the core of the electromagnet compressing said coil spring between said flange and said base portion of the net, and a trigger switch mounted in the net in such a way that said trigger switch closes when a ball falls into said net, an electric circuit connected to said trigger switch so that when a ball falls into said net and closes said trigger switch the electromagnet is energized drawing the said armature into the core of said electromagnet and compressing said spring between said ball hitting flange and the base portion of said net, said circuit including circuit interrupting means connected to said trigger switch in such a way that after said electromagnet is energized drawing said armature into its core and compressing said spring, the circuit is interrupted causing the magnetic force exerted by the electromagnetic to disappear so that the coil spring suddenly expands ejecting the retracted armature from the core of the electromagnet until the ball hitting flange strikes the ball in the net driving it out of the net.

* * * * *